US010834502B2

(12) United States Patent
Groh

(10) Patent No.: US 10,834,502 B2
(45) Date of Patent: Nov. 10, 2020

(54) METHOD AND DEVICE FOR MIXING N INFORMATION SIGNALS

(71) Applicant: INSTITUT FUR RUNDFUNKTECHNIK GMBH, Munich (DE)

(72) Inventor: Jens Groh, Munich (DE)

(73) Assignee: Institut Fur Rundfunktechnik GMBH, Munich (DE)

( * ) Notice: Subject to any disclaimer, the term of this patent is extended or adjusted under 35 U.S.C. 154(b) by 0 days.

(21) Appl. No.: 16/604,641

(22) PCT Filed: Apr. 10, 2018

(86) PCT No.: PCT/DE2018/100326
§ 371 (c)(1),
(2) Date: Oct. 11, 2019

(87) PCT Pub. No.: WO2018/188697
PCT Pub. Date: Oct. 18, 2018

(65) Prior Publication Data

US 2020/0162814 A1 May 21, 2020

(30) Foreign Application Priority Data

Apr. 12, 2017 (IT) ..... 102017000040732

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2430/03* (2013.01)

(58) Field of Classification Search
CPC .... H04R 3/005; H04R 1/406; H04R 2430/03; H04S 7/30; H04S 5/005; H04S 5/00; H04S 2420/07
See application file for complete search history.

(56) References Cited

U.S. PATENT DOCUMENTS

2008/0112574 A1* 5/2008 Brennan ..... H04R 3/005 381/92
2014/0105416 A1 4/2014 Huttunen et al.
(Continued)

FOREIGN PATENT DOCUMENTS

DE 10 2008 004674 A1 6/2009
DE 10 2009 052992 B3 3/2011
(Continued)

OTHER PUBLICATIONS

International Search Report dated Jul. 12, 2018, issued in PCT Application No. PCT/DE2018/100326, filed Apr. 10, 2018.
(Continued)

*Primary Examiner* — Yogeshkumar Patel
(74) *Attorney, Agent, or Firm* — Workman Nydegger

(57) ABSTRACT

Mixing N information-time signals. The time signals are each converted into the frequency domain, into one of N complex information signals where N is an integer greater than 1. Spectral values of the N complex information signals which match in a frequency are each converted into a first and a second component. The N first components of the N frequency-matching spectral values are combined into a first combination component. The N second components of the N frequency-matching spectral values are combined into a second combination component. The first and second combination components are combined into a result spectral value. The above steps are also performed for other frequency-matching spectral values of the N complex information signals for generating other result spectral values. The result spectral values thus obtained are combined into a complex output information signal.

12 Claims, 9 Drawing Sheets

(56) References Cited

U.S. PATENT DOCUMENTS

| | | | | |
|---|---|---|---|---|
| 2014/0270241 | A1 | 9/2014 | Yu et al. | |
| 2014/0286508 | A1* | 9/2014 | Weitnauer ..... | H04R 3/00 381/122 |
| 2016/0379664 | A1 | 12/2016 | Chen et al. | |

FOREIGN PATENT DOCUMENTS

| | | | |
|---|---|---|---|
| DE | 10 2014 108345 | A1 | 12/2015 |
| GB | 2 453 118 | A | 4/2009 |
| WO | 2003/015464 | A2 | 2/2003 |
| WO | 2013/050575 | A1 | 4/2013 |
| WO | 2014/085978 | A1 | 6/2014 |
| WO | 2014/182660 | A1 | 11/2014 |
| WO | 2014/187877 | A1 | 11/2014 |
| WO | 2016/160821 | A1 | 10/2016 |

OTHER PUBLICATIONS

Written Opinion dated Jul. 12, 2018, issued in PCT Application No. PCT/DE2018/100326, filed Apr. 10, 2018.

* cited by examiner (a)

(b)

(c)

(d)

(a)

(b)

(c)

(d)

METHOD AND DEVICE FOR MIXING N INFORMATION SIGNALS

INTRODUCTION

The invention relates to a method and an apparatus for mixing N information time signals which are respectively converted from the time domain to the frequency domain into one of N complex information signals, where N is an integer greater than 1. Such a method or such an apparatus is used, for instance, for interpolating or extrapolating microphone signals.

EP 2994094B1 discloses a method and an apparatus where an interpolated or extrapolated signal is generated from at least two microphone signals by mixing the microphone signals.

The known method relates to applications where microphones are in a sound field, where they convert a sound field value (e.g., the sound pressure) at their respective microphone positions into microphone signals, and where an estimate of the value of the sound field measure outside the microphone positions is desired, i.e., at a position interpolated or extrapolated from the microphone positions.

In the known method, the interpolated or extrapolated signal is similar to the sound field value at the interpolated or extrapolated position. The known method uses energy-based weighting of complex spectral values as well as a summation of the weighted complex spectral values which includes a correction to compensate for an energy error. As a result of the correction in the known method, the interpolated or extrapolated signal has the property of deviating only insignificantly in its mean energy from the sound field value at the interpolated or extrapolated position and retains this property even if the sound field is generated by sound waves of more than one sound source. The factors of the weighting in the known method are derived from the coefficients in the mathematical representation of the interpolated or extrapolated "virtual" position.

In the known method, the phase of the interpolated or extrapolated signal is not equal to the phase of the sound field value at the interpolated or extrapolated position. This is even the case in the known method if a direct sound field emanates from a single sound source. In the case where the sound field results from the sound waves from more than one sound source, the signal interpolated or extrapolated according to the known method differs even more in its phase from the sound field value at the interpolated or extrapolated position. Further, in the known method, extrapolation beyond more than one time the distance of the microphones is not possible. The microphone signals and the mentioned interpolated or extrapolated signals are complex-valued signals which, as is common, describe the state of a variable, in the present case the sound field value, with respect to a frequency.

An interpolated or extrapolated position is usually computed as a combination of the positions interpreted as vectors, in particular as a coefficient-weighted sum of the vectors, with the additional condition that the sum of the coefficients is equal to 1. Due to the additional condition, the number of dimensions of the interpolation or extrapolation becomes 1 less than the number of positions. This thus describes, for example, in the case of 2 positions, a one-dimensionally interpolated position on the straight line through the positions, or in the case of 3 positions, a two-dimensionally interpolated position in the plane through the positions, or in case of 4 positions a three-dimensional interpolated or extrapolated position in space.

The coefficients may be used as control parameters in regard to the object of the invention.

It should be pointed out that in the case of a direct sound field emanating from a single sound source, a meaningful statement about the phase of the sound field value at an interpolated or extrapolated position can be made as there is a physical relationship between the phase and the position in space, which can be approximated as a linear function by assuming a plane wave front.

It should be noted that, in the case of a diffuse sound field, a meaningful statement about the energy of the sound field value at an interpolated or extrapolated position is possible because there is a physical relationship between the energy and the position in space, which, assuming temporal averaging, can be approximated as constant.

In many practical applications, there is a sound field resulting from the sound waves from more than one sound source or from a superposition of direct sound and diffused sound.

BRIEF DESCRIPTION OF THE INVENTION

It is the object of the invention to further improve the generation of an interpolated or extrapolated signal from at least two microphone signals. The microphones, which convert a sound field value into the microphone signals, are located at different microphone positions in a sound field.

The goal is that the interpolated or extrapolated signal deviates in its phase and in its energy at most insignificantly, as far as possible, from the value that the sound field value has at a position interpolated or extrapolated from the microphone positions.

A method according to one embodiment of the invention is characterized by acts for mixing N information-time signals. The time signals are each converted into the frequency domain, into one of N complex information signals where N is an integer greater than 1. Spectral values of the N complex information signals which match in a frequency are each converted into a first and a second component. The N first components of the N frequency-matching spectral values are combined into a first combination component. The N second components of the N frequency-matching spectral values are combined into a second combination component. The first and second combination components are combined into a result spectral value. The above steps are also performed for other frequency-matching spectral values of the N complex information signals for generating other result spectral values. The result spectral values thus obtained are combined into a complex output information signa.

The invention will be further described in the following description of the figures.

BRIEF DESCRIPTION OF THE FIGURES

The invention will be described in more detail in the following description of the figures with reference to several embodiments.

DETAILED DESCRIPTION

The mixing method according to the invention will be further detailed with reference to FIG. 1. We start with two information signals, e.g., two microphone signals, which are mixed together, for example, for interpolation or extrapolation of the microphone signals.

The result signal produced by the mixture may then be equalized, by interpolation, to a microphone signal of a fictitious microphone located at a location between the two microphones on the line connecting the two microphones. With an extrapolation, the result signal may then be equalized to a microphone signal of a fictitious microphone located at a location outside the two microphones on the connecting line through the two microphones.

Figure 1:
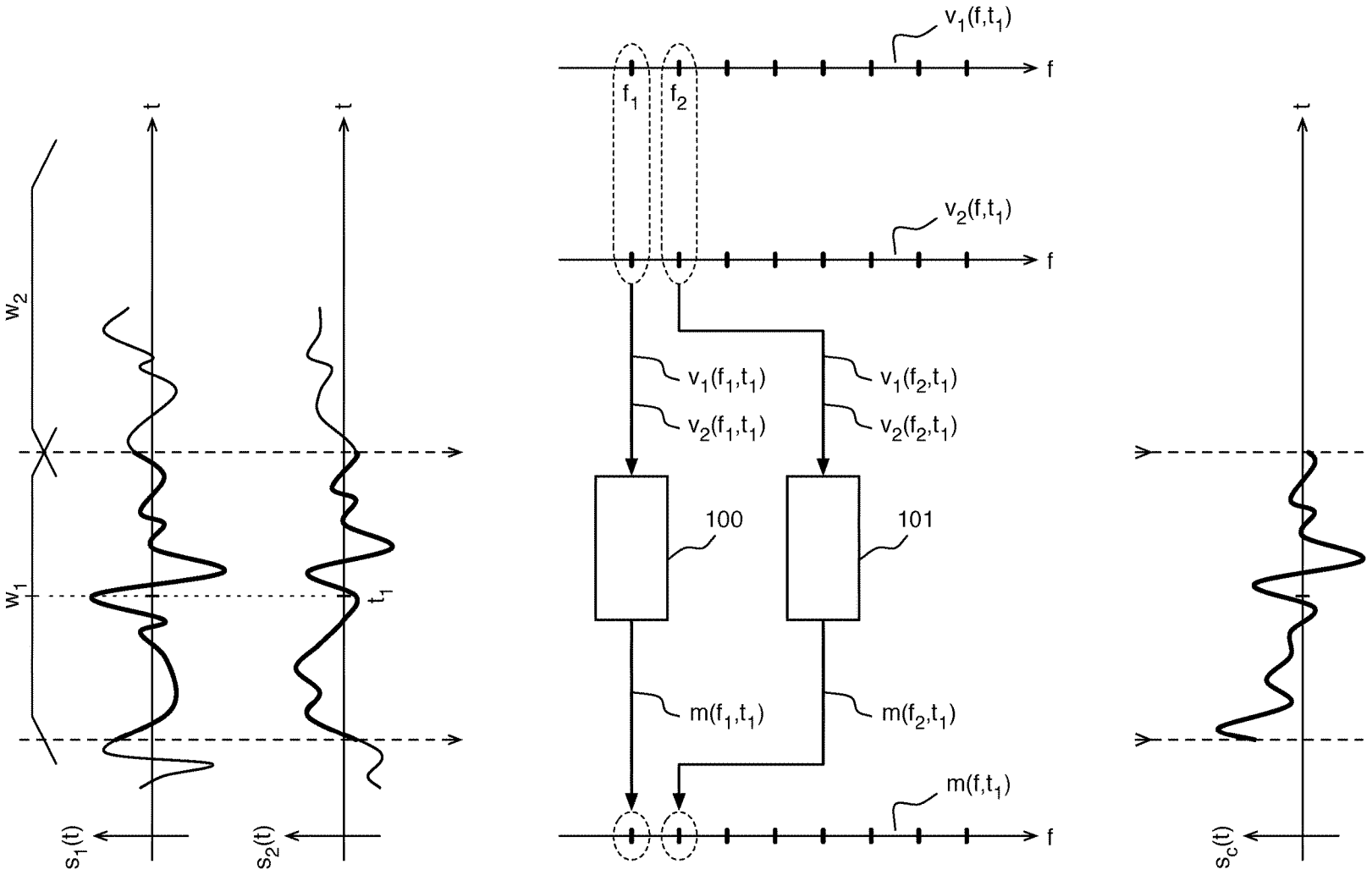
FIG. 1 shows how the mixing of (N=) two complex information signals is realized according to the invention.

The two microphone signals are illustrated in FIG. 1 as a function of time by $s_1(t)$ and $s_2(t)$. These signals are first converted by means of a transformation from the time domain to the frequency domain. For this purpose, the time signals within a time interval indicated by $W_1$ are converted into the frequency domain. This conversion may, for example, take place by means of a Fourier transform. This results in transformed complex information signals $v_1(f, t_1)$ or $v_2(f, t_1)$ that are functions of the frequency f.

Thereafter, frequency-matching complex spectral values $v_1(f_1, t_1)$ and $v_2(f_1, t_1)$ of the two transformed complex information signals are mixed in a mixing method to obtain a result spectral value $m(f_1, t_1)$, as schematically indicated in FIG. 1 by reference numeral 100. This method, which will be further detailed below, is thereafter repeated for succeeding frequency-matching spectral values $v_1(f_2, t_1)$ and $v_2(f_2, t_1)$. This repeated method is schematically illustrated in FIG. 1 by the reference numeral 101, and leads to a result vector $m(f_2, t_1)$. This mixing method is repeated over and over to obtain a complex output information signal $m(f, t_1)$ as a function of the frequency.

It should be noted here that the mixing methods indicated by blocks 100 and 101 in FIG. 1 may be carried out successively by temporal repetition, or may be carried out in parallel at the same time, so that the complex output information signal $m(f, t_1)$ may be generated in one system cycle of the controller of the mixing process.

After an inverse transformation of the complex output information signal $m(f, t_1)$ from the frequency domain into the time domain, such as, for example, by means of an inverse Fourier transform, the mixed time signal $s_c(t)$ in the time interval $W_1$ is obtained.

The method now described may then be repeated for a subsequent time interval, as indicated by $W_2$ in FIG. 1.

Figure 2:
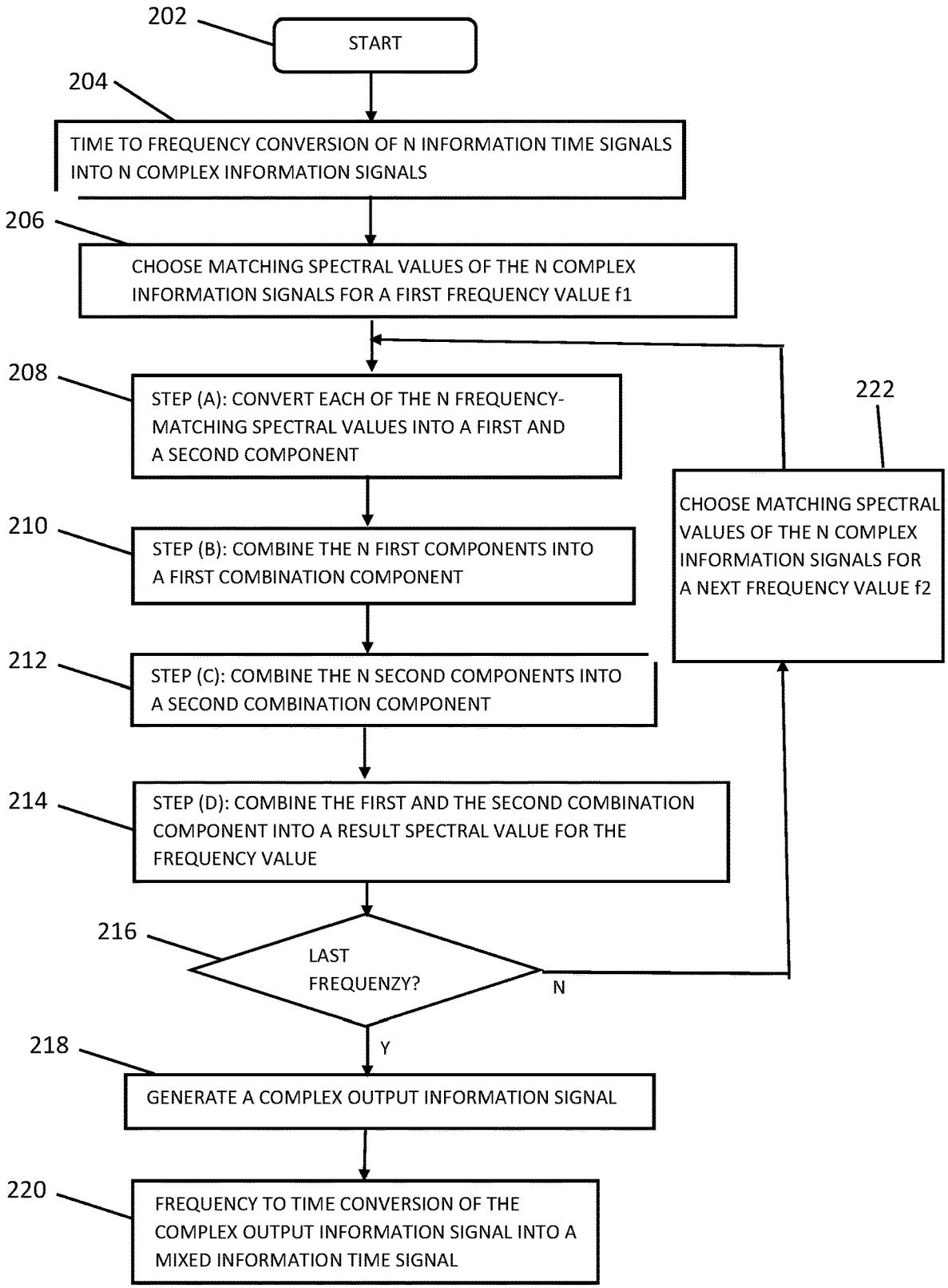
FIG. 2 is a flow chart of the mixing method according to the invention.

FIG. 2 shows in a flowchart how the mixing of two frequency-matching complex spectral values takes place. After the start of the method at block 202, the N (with N being equal to two in this case) microphone signals $s_1(t)$ and $s_2(t)$ are first converted from the time domain to the frequency domain at block 204. This produces N(=2) transformed complex information signals $v_1(f, t_1)$ and $v_2(f, t_1)$. Thereafter, at block 206, N (equal to two) frequency-matching spectral values of the N(=2) complex information signals are selected. These are, for example, the spectral values $v_1(f_1, t_1)$ and $v_2(f_1, t_1)$ for a first frequency value $f_1$ of FIG. 1.

According to the invention, each of the (N=) two complex spectral values is converted into a first component and a second component at block 208 (in FIG. 2 also indicated as step A). This will be further detailed below with reference to FIG. 3*a*. At block 210 (also indicated as step B), the first components of the (N=) two complex spectral values are combined to form a first combination component. This will be further detailed below with reference to FIG. 3*b*. At the next block 212 (in FIG. 2 indicated as step C), the second components of the (N=) two complex spectral values are combined into a second combination component. This will be further detailed below with reference to FIG. 3*c*. Thereafter, at block 214 (in FIG. 2 indicated as step D), the first combination component and the second combination component are combined to obtain a result spectral value. This will be further detailed below with reference to FIG. 3*d*. In this way, the result spectral value $m(f_1, t_1)$ was derived from the two spectral values $v_1(f_1, t_1)$ and $v_2(f_1, t_1)$. The method is now repeated for the next (N=) two frequency-matching spectral values $v_1(f_2, t_1)$ and $v_2(f_2, t_1)$ for a next frequency value $f_2$. This is shown in FIG. 2 by blocks 216 and 222. At block 216, it is determined that not all spectral values have yet been processed by the method. At block 222, the (N=) two next frequency-matching spectral values of the two complex information signals are selected and forwarded to block 208. Thereafter, the method according to the invention is applied to the spectral values $v_1(f_2, t_1)$ and $v_2(f_2, t_1)$ for obtaining the result spectral value $m(f_2, t_1)$.

The method is thus performed for all frequency-matching spectral values of the (N=) two complex information signals until, at block 218, the complex output information signal $m(f, t_1)$ is obtained. Thereafter, at block 220, the complex output information signal is converted into the mixed time signal $s_c(t)$ by a back transformation from the frequency domain to the time domain.

As stated above, blocks 206 through 214 may be performed at the same time in parallel with each other in another embodiment of the flowchart for directly obtaining the complex output information signal $m(f, t_1)$.

Figure 3:
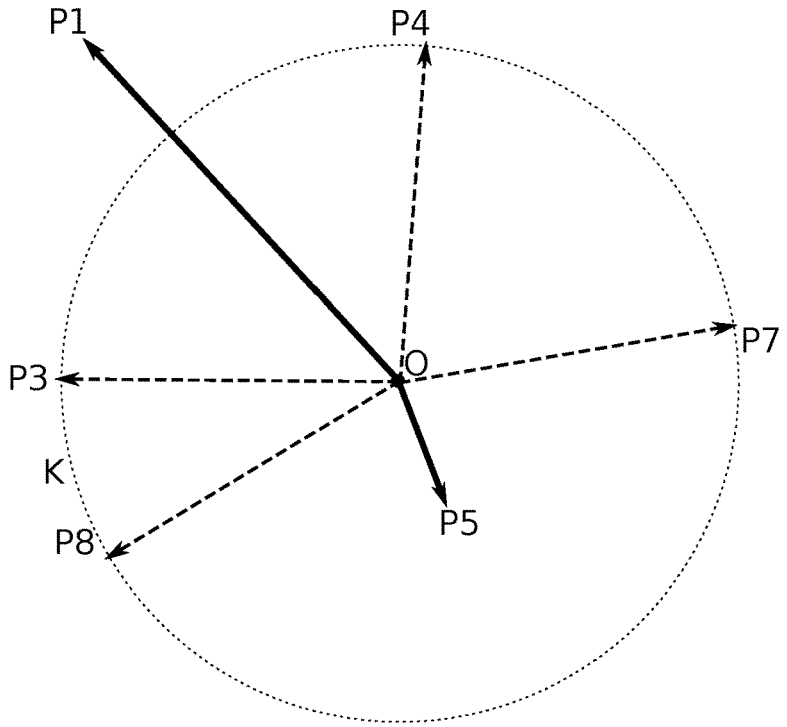
FIG. 3 shows how the mixing of (N=) two frequency-matching vectors of the (N=) two complex information signals is performed according to a first embodiment.
Figure 3:
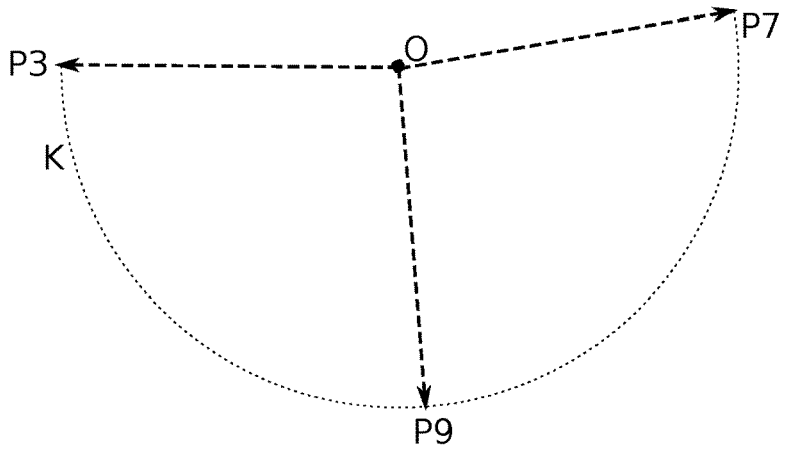
Figure 3:
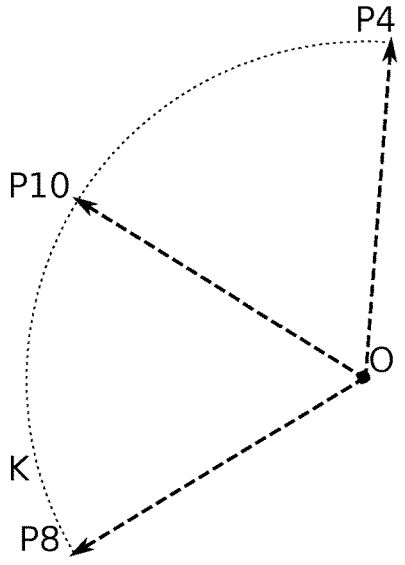
Figure 3:
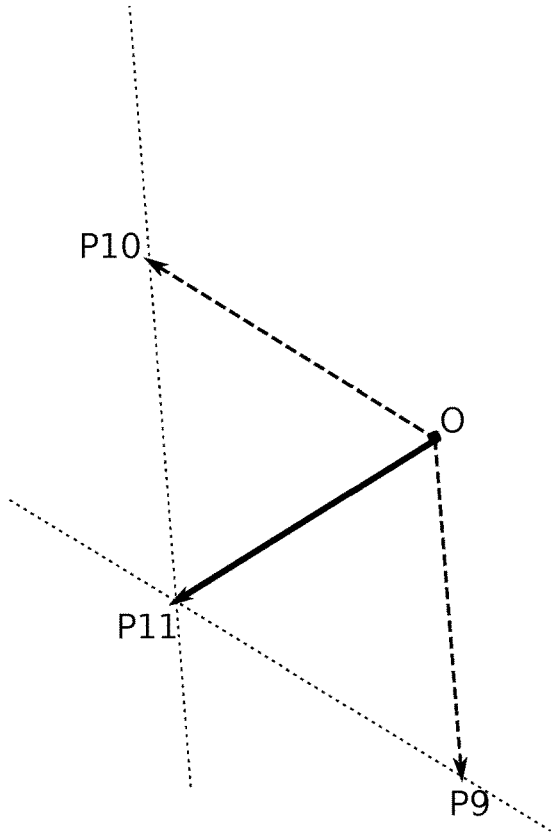

FIG. 3 further details the method as performed in blocks 208 to 214 in FIG. 2. FIG. 3*a* shows the two frequency-matching spectral values $v_1(f_1, t_1)$ and $v_2(f_1, t_1)$ in a complex plane as vectors OP1 and OP5, respectively, where O is the origin of the complex plane. In block 208, the spectral value $v_1(f_1, t_1)$ (=OP1) is converted into a first component OP3 and a second component OP4. The first component OP3 and the second component OP4 are selected in such a way that they yield the spectral value OP1 in case of a complex-valued addition of the components OP3 and OP4. In block 208, the spectral value $v_2(f_1, t_1)$ (=OP5) is converted into a first component OP7 and a second component OP8. The first component OP7 and the second component OP8 are selected in such a way that they yield the spectral value OP5 in case of a complex-valued addition of the components OP7 and OP8.

The end points of the first components OP3 and OP7 and the second components OP4 and OP8 lie on a circle K. In this embodiment of the invention, this means that the amplitudes or vector lengths of the first and second components are equal. The radius of the circle K is dependent on the absolute values of the two spectral values $v_1(f_1, t_1)$ and $v_2(f_1, t_1)$. In particular, the following applies:

A first energy value $E_1(f_1, t_1)$ is equal to: ABS $(v_1(f_1, t_1))^2$.

A second energy value E2 (f1, t1) is equal to: ABS (v2(f1, t1))$^2$.

The radius R of the circle K is thus equal to: SQRT $\{(E_1+E_2)/2\}$.

The root of the arithmetic mean of the energy values is hence a measure of the radius.

The determination of the radius in this first exemplary embodiment signifies the use of the assumption that the sound field consists of a superimposition of two direct sound fields, wherein the two assumed direct sound fields are equal, and thus causes that the estimate of the sound field value at the interpolated or extrapolated location is, as far as possible, independent of whether there is a direct sound field share in the sound field.

FIG. 3*b* shows how the first components OP3 and OP7 are combined into a first combination component OP9 at block 210 (step B). The end point P9 of the first combination component is hereby determined as follows.

In this regard, this section first describes the determination of the coefficients of a mix, e.g., an interpolation or extrapolation. A position interpolated or extrapolated from given positions can, as is known, be represented mathematically, for example, by a linear combination, which is to be used in the following.

If a mixture is an interpolation or an extrapolation, then the sum of the coefficients of the linear combination is equal to 1. A mathematical representation of a one-dimensionally linearly interpolated or extrapolated position L from two given positions L1 and L2 is $$L=L1*c1+L2*c2,$$

where c1 and c2 are coefficients, with $$c1+c2=1.$$

If the microphone positions of the microphones giving the corresponding microphone signals $s_1(t)$ and $s_2(t)$ are used for L1 and L2, then c1 and c2 are the coefficients of the interpolation or extrapolation according to the invention.

An interpolation of the first components OP3 and OP7 results in a combination component OP9 in FIG. 3*b*. The point P9 divides the circle section P3-K-P7 into two parts such that:

$$(\text{arc length of circle section } P3-P9)/(\text{arc length of circle section } P9-P7)=c1/c2.$$

FIG. 3*c* shows how the second components OP4 and OP8 are combined into a second combination component OP10 in block 212 (step C). The end point P10 of the first combination component is hereby determined as follows.

As already mentioned above in connection with FIG. 3*b*, in FIG. 3*c*, the circle section P4-K-P8 is also divided into two parts, by the point P10. The point P10 divides the circle section P4-K-P8 into two parts such that:

$$(\text{arc length of circle section } P4-P10)/(\text{arc length of circle section } P10-P8)=c1/c2.$$

FIG. 3*d* shows how in block 214 (step D) the first combination component OP9 and the second combination component OP10 are combined into a result spectral value OP11. This is realized by a complex-valued addition of the combination components OP9 and OP10.

The steps described above with reference to FIG. 3 are thus carried out repeatedly one after the other or in parallel, as mentioned in connection with FIG. 2, for obtaining the complex output information signal in the first embodiment of the method.

It is additionally mentioned here that the radius calculation always must be performed anew for new pairs of complex spectral values, such as $v_1(f_2, t_1)$ and $v_2(f_2, t_1)$.

In the method described above, a mixing has been performed which has led to an interpolation of the two information-time signals. This is because c1 and c2 were both positive and less than one. The method described above could also lead to extrapolation. In this case, one of the two coefficients c1 or c2 would be negative and the other greater than one, wherein c1+c2=1 would still apply. This would mean that points P9 and P10 are still on the circle, but outside of the section P3-K-P7 or P4-K-P8.

In a second embodiment, which will be further detailed with reference to FIG. 4, the mixing of the two complex information signals is executed as follows. FIG. 4*a* shows again the two frequency-matching spectral values $v_1(f_1, t_1)$ and $v_2(f_1, t_1)$ in the complex plane as vectors OP1 and OP5, respectively, where O is the origin of the complex plane. In block 208, the spectral value $v_1(f_1, t_1)$ (=OP1) is converted into a first component OP3 and a second component OP4. The first component OP3 and the second component OP4 are selected in such a way that they yield the spectral value OP1 in case of a complex-valued addition of the components OP3 and OP4. In block 208, the spectral value $v_2(f_1, t_1)$ (=OP5) is converted into a first component OP7 and a second component OP8. The first component OP7 and the second component OP8 are selected in such a way that they yield the spectral value OP5 in case of a complex-valued addition of the components OP7 and OP8.

The end points of the first components OP3 and OP7 lie on a circle K'. In this embodiment of the invention, this means that the amplitudes or vector lengths of the first components OP3 and OP7 are equal to one another. The end points of the first components OP4 and OP8 lie on a circle K". In this embodiment of the invention, this means that the amplitudes or vector lengths of the second components OP4 and OP8 are equal to one another.

The radii of the two circles K' and K" are unequal, but dependent on the absolute values of the two spectral values $v_1(f_1, t_1)$ and $v_2(f_1, t_1)$.

In this second embodiment, it is assumed that one of the two assumed direct sound fields dominates and thus causes the estimation of the value of the sound field variable at the interpolated or extrapolated position to be as accurate as possible for the direct sound field component that dominates the sound field. In particular, the following applies to the calculation of the radii:

$$EA=(E1+E2)/2+Ed$$

$$EB=(E1+E2)/2-Ed$$

Ed should be greater than zero. On the other hand, Ed must not become too large, because then, the division of one of the two spectral values into components would no longer be possible. This would be the one with the smaller vector length, in this case OP5 in FIG. 4*a*, and the limiting case of the maximum value for Ed is shown by way of example, in which the division is just still possible, and which can be seen from the fact that the spectral value OP5 is collinear with its components OP7 and OP8.

The radius R' of the circle K' is now equal to: SQRT (EA).

The radius R" of the circle K" is now equal to: SQRT (EB).

FIG. 4*b* shows how the first components OP3 and OP7 are combined into a first combination component OP9 at block 210 (step B). The end point P9 of the first combination component is again set in the same way, as already described above with reference to FIG. 3*b*.

The point P9 divides the circle section P3-K'-P7 into two parts such that:

$$(\text{arc length of circle section } P3-P9)/(\text{arc length of circle section } P9-P7)=c1/c2.$$

FIG. 4*c* shows how the second components OP4 and OP8 are combined into a second combination component OP10 in block 212 (step C). The end point P10 of the first combination component is hereby determined as follows.

As already mentioned above in connection with FIG. 4*b*, in FIG. 4*c*, the circle section P4-K"-P8 is also divided into two parts, by the point P10. The point P10 divides the circle section P4-K"-P8 into two parts such that: (arc length of circle section P4–P10)/(arc length of circle section P10–P8) =c1/c2.

FIG. 4*d* shows how in block 214 (step D) the first combination component OP9 and the second combination component OP10 are combined into a result spectral value OP11. This is realized by a complex-valued addition of the combination components OP9 and OP10.

The steps described above with reference to FIG. 4 are thus carried out repeatedly one after the other or in parallel, as mentioned in connection with FIG. 2, for obtaining the complex output information signal in the second embodiment of the method.

It is additionally mentioned here that the radii calculation always must be performed anew for new pairs of complex spectral values, such as $v_1(f_2, t_1)$ and $v_2(f_2, t_1)$.

In the method described above, a mixing has been performed which has led to an interpolation of the two information-time signals. This is because c1 and c2 were both positive and less than one. The method described above could also lead to extrapolation. In this case, one of the two coefficients c1 or c2 would be negative and the other one greater than 1, wherein c1+c2=1 would still apply.

Figure 4:
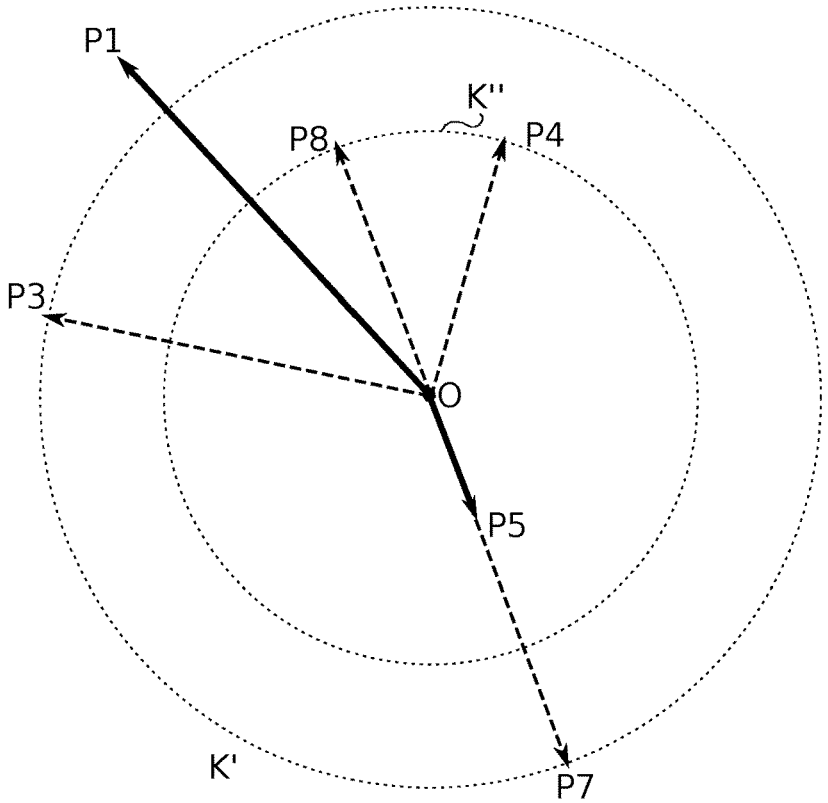
FIG. 4 shows how the mixing of two frequency-matching vectors of the (N=) 2 complex information signals is performed according to a second embodiment.
Figure 4:
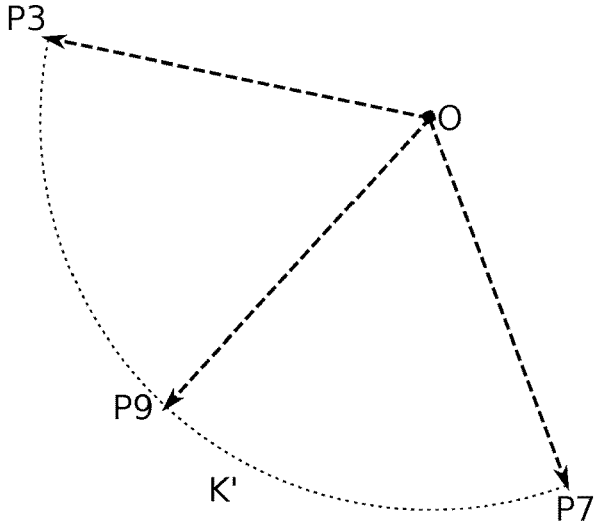
Figure 4:
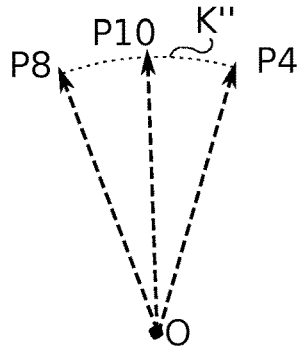
Figure 4:
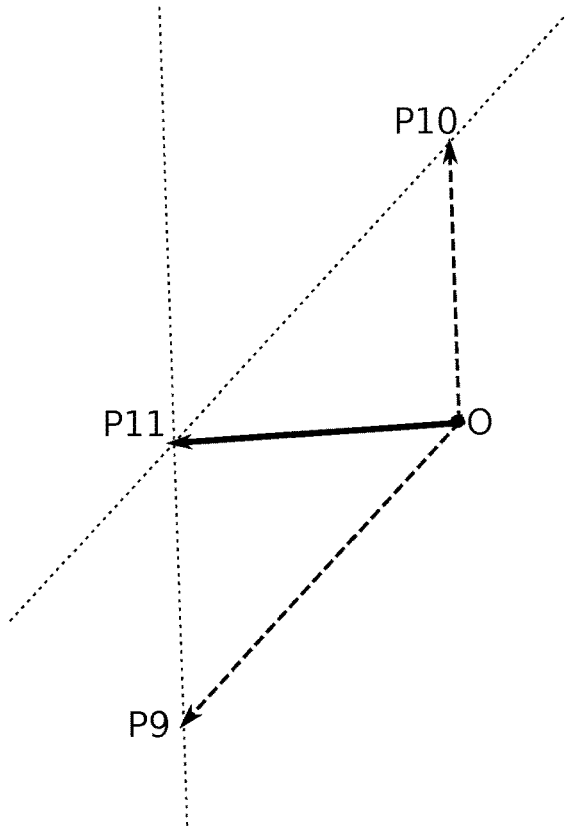
Figure 5:
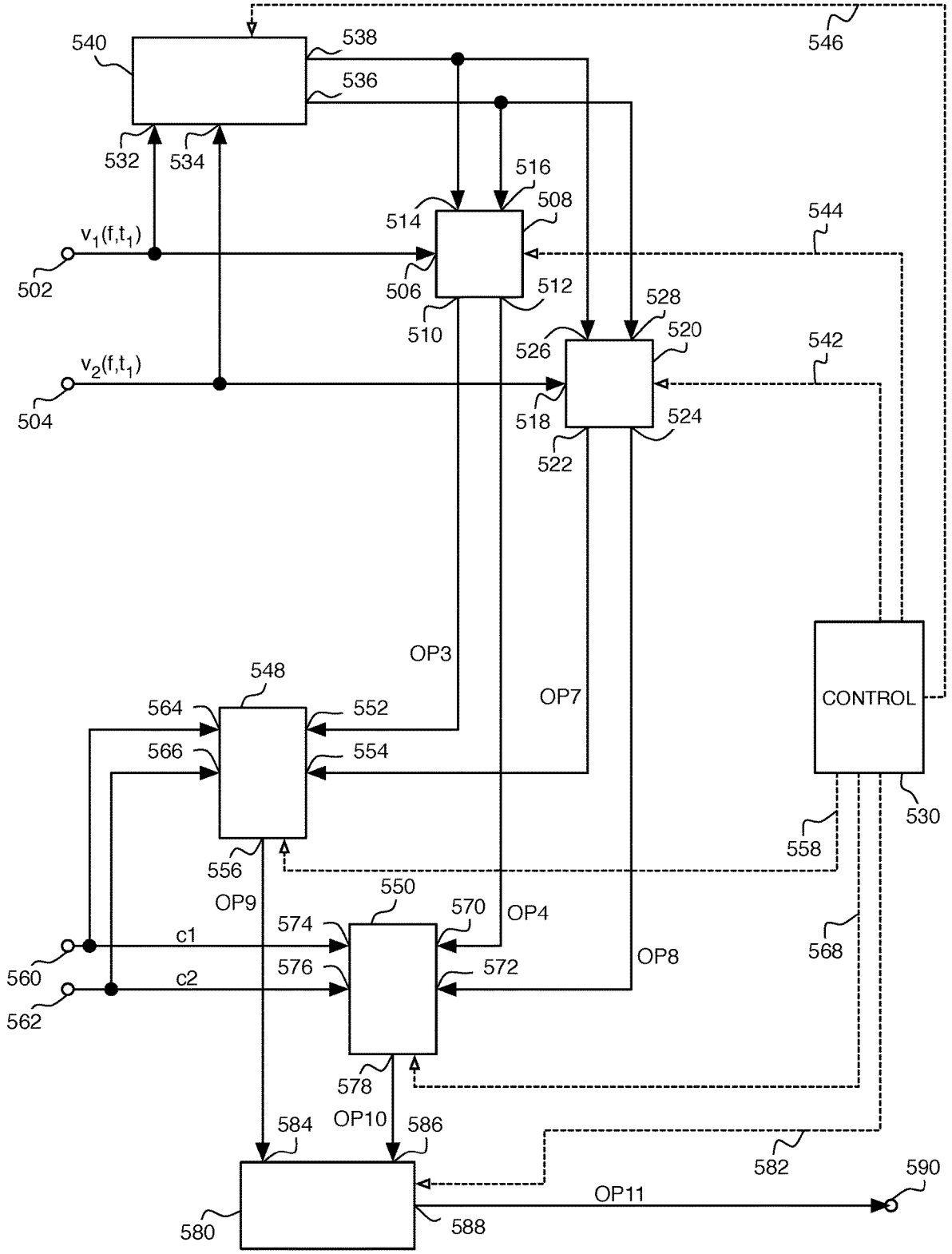
FIG. 5 shows an embodiment of a mixing apparatus for mixing (N=) two information signals, which are each converted from the time domain to the frequency domain.

FIG. 5 shows an embodiment of a mixing apparatus for carrying out the method as described above. Inputs 502 and 504 are provided for receiving the (N=) two complex information signals $v_1(f, t_1)$ and $v_2(f, t_1)$, respectively. Input 502 is coupled to input 506 of unit 508. Input 504 is coupled to input 518 of unit 520. Units 508 and 520 form a first unit for converting each of the frequency-matching spectral values of the (N=) two complex information signals into a first and a second component as described with reference to FIGS. 3*a* and 4*a*, respectively. This means that, under the influence of control via control lines 542 and 544 from control unit 530, frequency-matching spectral values $v_1(f_1, t_1)$ and $v_2(f_1, t_1)$ (OP1 and OP5 in FIGS. 3*a* and 4*a*) are received by units 508 and 520 at their inputs 506 and 518, respectively, and the two first components (OP3 or OP7 in FIGS. 3*a* and 4*a*) and the two second components (OP4 or OP8 in FIGS. 3*a* and 4*a*) are generated by these units. The first component OP3 is supplied by unit 508 at its output 510. The first component OP4 is supplied by unit 508 at its output 512. The first component OP7 is supplied by unit 520 at its output 522 and the second component OP8 is supplied by unit 520 at its output 524.

Unit 540 is provided to calculate the radius of the circle K in FIG. 3 or the radii of the circles K' and K" in FIG. 4. Inputs 502 and 504 of the mixing apparatus are coupled to associated inputs 532 and 534, respectively, of unit 540*o*. In the case of the second embodiment, unit 540 derives, under control of the control line 546 from control unit 530, the energies EA and EB, as described above, from the complex information signals $v_1(f, t_1)$ and $v_2(f, t_1)$ supplied to inputs 502 and 504. Then, unit 540 derives the radii of the circles K' and K' from the energy values EA and EB (see FIG. 4*a*) and provides them at outputs 538 and 536, respectively. Output 538 of unit 540 is coupled to inputs 514 and 526 of units 508 and 520, respectively, for supplying the value of the radius of the circle K' to units 508 and 520. Output 536 of unit 540 is coupled to inputs 516 and 528 of units 508 and 520, respectively, for supplying the value of the radius of the circle K" to units 508 and 520.

In the first embodiment, only one value of the radius of the circle K is derived in unit 540, see FIG. 3*a*, and supplied to units 508 and 520. In the first embodiment, there is thus only one connection line provided between unit 540 and units 508 and 520. The mixing apparatus further includes unit 548. In unit 548, the two first components OP3 and OP7, generated by unit 508 and 520, respectively, are combined, under the control of a control line 558 from control unit 530, into a first combination component OP9, as already explained with reference to FIGS. 3*b* and 4*b*. To this end, outputs 510 of unit 508 and 522 of unit 520 are coupled to associated inputs 552 and 554, respectively, of unit 548. Unit 548 also needs the radius value of the circle K or K', see FIGS. 3*b* and 4*b*. For this purpose, a coupling could be provided between unit 540 and unit 548 for supplying the value of the radius of the circle K or K'. Or, unit 548 may derive the radius value of the circle K or K' from the two first components OP3 and OP7 supplied to it.

For deriving the first combination component, the coefficients c1 and c2 are also needed. It should be noted, however, and it will be explained later with reference to FIG. 7, that one coefficient less than the number N of the information signals is required.

These two coefficients are supplied via inputs 560 and 562, respectively, or the one coefficient is supplied via only one input, either 560 or 562, to the mixing apparatus. These inputs are coupled to associated inputs 564 and 566, respectively, of unit 548. The first combination component OP9 is then available at output 556 of unit 548.

The mixing apparatus further includes a unit 550. In unit 550, the two second components OP4 and OP8, generated by unit 508 and 520, respectively, are combined, under the control of a control line 568 from control unit 530, into a second combination component OP10, as already explained with reference to FIGS. 3*c* and 4*c*. To this end, outputs 512 of unit 508 and 524 of unit 520 are coupled to associated inputs 570 and 572, respectively, of unit 550. Unit 550 also needs the radius value of the circle K or K', see FIGS. 3*c* and 4*c*. For this purpose, a coupling could be provided between unit 540 and unit 550 for supplying the value of the radius of the circle K or K". Or, unit 550 may derive the radius value of the circle K or K" from the two second components OP4 and OP8 supplied to it.

For deriving the second combination component, the coefficients c1 and c2 are also needed. Inputs 560 and 562 of the mixing apparatus are coupled to associated inputs 574 and 576, respectively, of unit 550. The second combination component OP10 is then available at output 578 of unit 550.

The mixing apparatus further includes unit 580. In unit 580, the first and second combination components OP9 and OP10 are combined, under control via a control line 582 from control unit 530, into a result spectral value OP11, as described above in connection with FIGS. 3*d* and 4*d*. To this end, outputs 556 of unit 578 and 548 of unit 550 are coupled to associated inputs 584 and 586, respectively, of unit 580. Output 588 of unit 580 is coupled to output 590 of the mixing apparatus.

Control unit 530 controls the units in the mixing apparatus such that two frequency-matching spectral values of two complex information signals are repeatedly processed in accordance with the steps of generating a result spectral value as described with reference to FIG. 2 for obtaining the complex output information signal at output 590. Or the mixing apparatus is implemented multiple times as in FIG. 5, for simultaneously deriving the result spectral values m (f, $t_1$). The control unit 530 should then be designed accordingly to allow for parallel processing.

Figure 6:
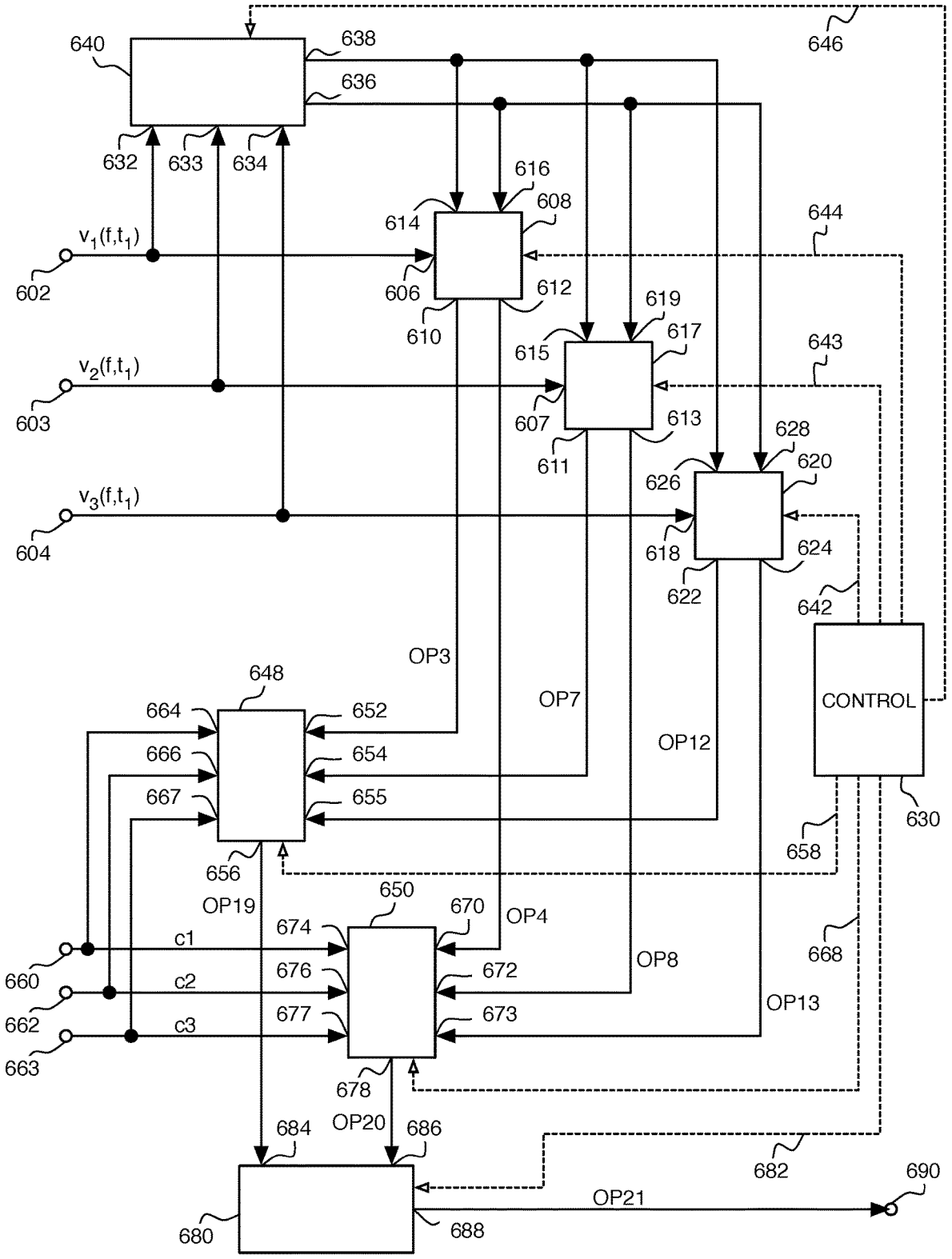
FIG. 6 shows an embodiment of a mixing apparatus for mixing (N=) three information signals, which are each converted from the time domain to the frequency domain.

FIG. 6 shows an embodiment of a mixing apparatus for mixing (N=) three information signals, which are each converted from the time domain to the frequency domain.

In this case, we have N=3 and a computational representation of a position L which is two-dimensionally linearly interpolated or extrapolated from three given positions L1, L2 and L3 is $$L=L1*c1+L2*c2+L3*c3,$$

where c1, c2 and c3 are coefficients, with $$c1+c2+c3=1.$$

If L1, L2 and L3 are replaced by the microphone positions of the microphones providing the corresponding microphone signals $s_1(t)$, $s_2(t)$ and $s_3$ (t), then c1, c2 and c3 are the coefficients of the interpolation or extrapolation according to the invention.

Inputs 602, 603 and 604 are envisaged for receiving the (N=) three complex information signals $v_1(f, t_1)$, $v_2(f, t_1)$ and $v_2(f, t_1)$, respectively. Input 602 is coupled to input 606 of unit 608. Input 603 is coupled to input 607 of unit 617. Input 604 is coupled to input 618 of unit 620. Units 608, 617 and 620 form a first unit for converting each of the frequency-matching spectral values of the (N=) three complex information signals into a first and a second component as described with reference to FIGS. 3*a* and 4*a*, respectively. This means that, under the influence of control via control lines 642, 643 and 644 from control unit 630, frequency-matching spectral values $v_1(f_1, t_1)$ (OP1 in FIGS. 3*a* and 4*a*), $v_2(f_1, t_1)$ (OP5 in FIGS. 3*a* and 4*a*) and $v_3$ $(f_1, t_1)$ are received by units 608, 617 and 620, respectively, at their inputs 606, 607 and 618, respectively, and the three first components (OP3, OP7, OP12) and the three second components (OP4, OP8, OP13) are generated by these units. The first component OP3 is supplied by unit 608 at its output 61*o*. The second component OP4 is supplied by unit 608 at its output 612. The first component OP7 is supplied by unit 617 at its output 611 and the second component OP8 is supplied by unit 617 at its output 613. The first component OP12 is supplied by unit 620 at its output 622 and the second component OP13 is supplied by unit 620 at its output 624.

Unit 640 is provided to calculate the radius of the circle K in FIG. 3 or the radii of the circles K' and K" in FIG. 4. Inputs 502 and 504 of the mixing apparatus are coupled to associated inputs 532 and 534, respectively, of unit 540. In the case of the second embodiment, unit 640 derives, under control of control line 646 from control unit 630, the energies EA and EB, as described in the following, from the complex information signals $v_1(f, t_1)$, $v_2(f, t_1)$ and $v_3(f, t_1)$ supplied to inputs 602, 603 and 604.

A first energy value E1 $(f_1, t_1)$ is equal to: ABS $(v_1(f_1, t_1))^2$.

A second energy value E2 $(f_1, t_1)$ is equal to: ABS $(v_2(f_1, t_1))^2$.

A third energy value E3 (f1, t1) is equal to: ABS $(v^3 (f_1, t_1))^2$.

The radius R of the circle K is now equal to: SQRT {(E1+E2+E3)/3}.

The following applies to the derivation of K' and K".

In this case, unit 640 derives the radii of the circles K' and K" from the energy values EA and EB (see FIG. 4*a*) as follows and provides them at outputs 638 and 636, respectively.

$$EA=(E1+E2+E3)/3+Ed$$

$$EB=(E1+E2+E3)/3-Ed$$

Ed should be greater than zero. On the other hand, Ed must not become too large, because then, the division of one of the three spectral values into components would no longer be possible.

The radius R' of the circle K' is now equal to: SQRT (EA).

The radius R" of the circle K" is now equal to: SQRT (EB).

Output 638 of unit 540 is coupled to inputs 614, 615 and 626 of units 608, 617 and 620, respectively, for supplying the value of the radius of the circle K' to units 608, 617 and 620. Output 636 of unit 640 is coupled to inputs 616, 619 and 628 of units 608, 617 and 620, respectively, for supplying the value of the radius of the circle K" to units 608, 617 and 620.

In the first embodiment, only one value of the radius of the circle K is derived in unit 640, see FIG. 3*a*, and supplied to units 608, 617 and 620. In the first embodiment, only one connection line is then provided between unit 640 and units 608, 617 and 620.

Figure 7:
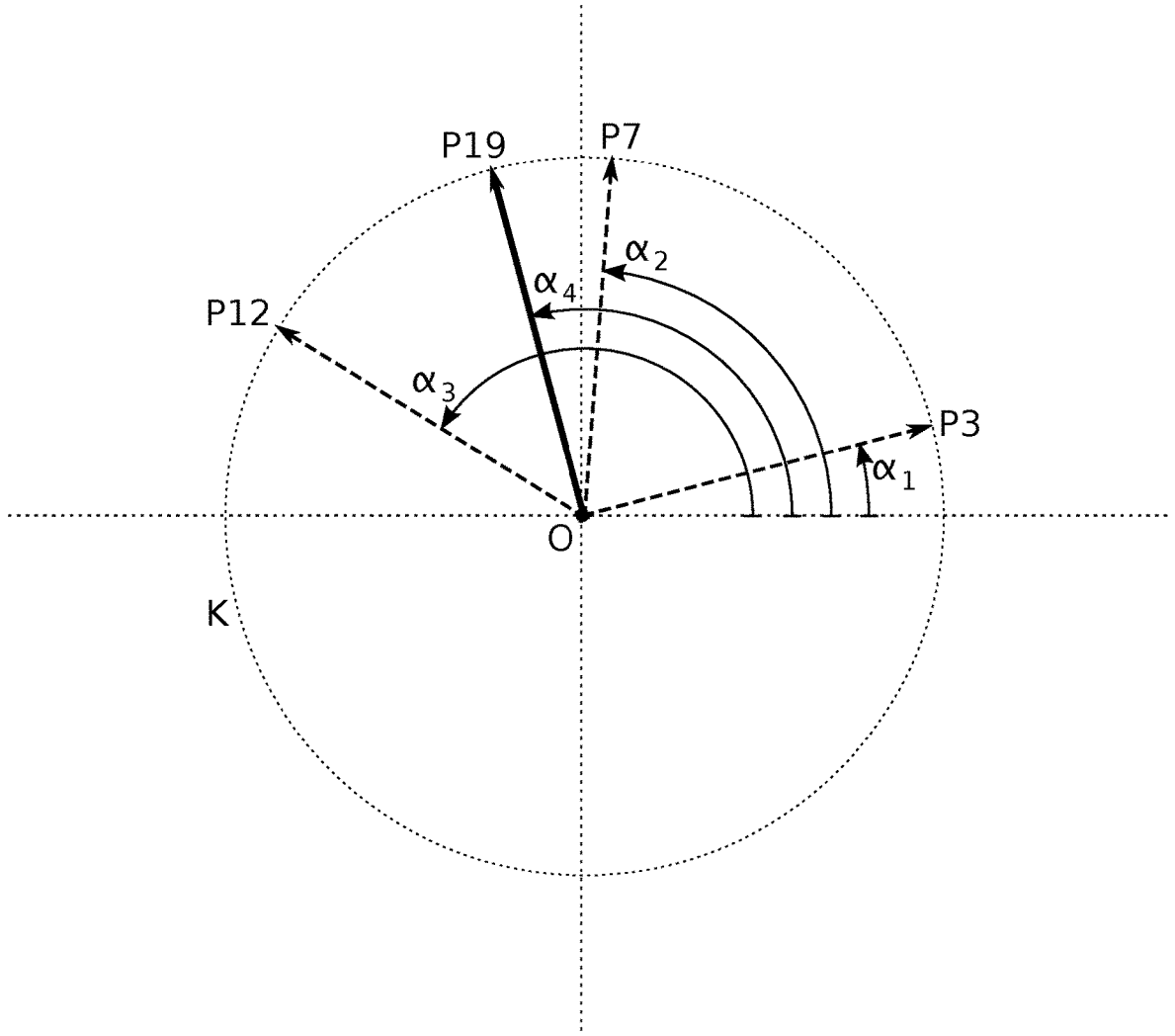
FIG. 7 shows an embodiment of a derivation of a combination component from three first components.

The mixing apparatus further includes unit 648. In unit 648, the three first components OP3, OP7 and OP12 generated by units 608 and 617 and 620, respectively, are combined, under the control of control line 658 from control unit 630, into a first combination component OP19. This will be further detailed with reference to FIG. 7. FIG. 7 shows the three components OP3, OP7 and OP12 and the combination component OP19 in the complex plane. The component OP3 has an angle to an axis, e.g. to the horizontal axis of the complex plane, which is equal to $\alpha_1$. The component OP7 has an angle to the horizontal axis which is equal to $\alpha_2$. The component OP12 has an angle to the horizontal axis which is equal to $\alpha_3$. And the combination component OP19 has an angle to the horizontal axis which is equal to $\alpha_4$. The following relationship applies between the angles $\alpha_1$, $\alpha_2$, $\alpha_3$ and $\alpha_4$:

$$\alpha_4=c1*\alpha_1+c2*\alpha_2+c3*\alpha_3 \quad \text{formula(1) or}$$

$$\alpha_4'=c2*\alpha_2'+c3*\alpha_3' \quad \text{formula(2)}$$

where $\alpha_4'$ is the angle between OP3 and OP19, $\alpha_2'$ is the angle between OP3 and OP7, and $\alpha_3'$ is the angle between OP3 and OP12.

If formula (2) is used to derive OP19, it is assumed that c1=0, so that c2+c3=1.

To this end, outputs 6100 of unit 608, 611 of unit 622 are coupled to associated inputs 652, 654 and 655, respectively, of unit 648. Unit 648 also needs the radius value of the circle K or K', see FIGS. 3*b* and 4*b*. For this purpose, a coupling could be provided between unit 640 and unit 648 for supplying the value of the radius of the circle K or K'. Or, unit 648 may derive the radius value of the circle K or K' from the three first components OP3, OP7 and OP12 supplied to it.

The derivation of the first combination component OP19 from OP3, OP7 and OP12 takes place in unit 648 as already described with reference to FIG. 7.

These three or two coefficients are supplied to the mixing apparatus via inputs 660, 662, 663 or inputs 662, 663. These inputs are coupled to associated inputs 664, 666 and 667, respectively, of unit 648. The first combination component OP9 is then available at output 656 of unit 648.

The mixing apparatus further includes a unit 650. In unit 650, the three second components OP4, OP8 and OP13, generated by unit 608, 617 and 620, respectively, are combined, under the control of a control line 668 from the control unit 630, into a second combination component OP2*o*, as already explained with reference to FIG. 7. To this end, outputs 612 of unit 608, 613 of unit 617 and 624 of unit 620 are coupled to associated inputs 670, 672 and 673, respectively, of unit 650. Unit 650 also needs the radius value of the circle K or K", see FIGS. 3*c* and 4*c*. For this purpose, a coupling could be provided between unit 640 and unit 650 for supplying the value of the radius of the circle K or K". Or, unit 650 may derive the radius value of the circle K or K" from the three second components OP4, OP8 and OP13 supplied to it.

For deriving the second combination component OP2*o*, the coefficients ct, c2 and c3 are also needed. Inputs 660, 662 and 663 of the mixing apparatus are coupled to associated inputs 674, 676 and 667, respectively, of unit 650. The second combination component OP20 is then available at output 678 of unit 650.

The mixing apparatus further includes unit 680. In unit 680, the first and second combination components OP19 and OP20 are combined, under control via control line 682 from control unit 630, into a result spectral value OP21, as described above in connection with FIGS. 3*d* and 4*d*. To this end, outputs 656 and 678 of unit 648 and 650, respectively, are coupled to associated inputs 684 and 686, respectively, of unit 68*o*. Output 688 of unit 680 is coupled to output 690 of the mixing apparatus.

Control unit 630 controls the units in the mixing apparatus such that three frequency-matching spectral values of three complex information signals are repeatedly processed in accordance with the steps of generating a result spectral value as described with reference to FIG. 2 for obtaining the complex output information signal at output 69*o*. Or the mixing apparatus is implemented multiple times as in FIG. 6, for simultaneously deriving the result spectral values m(f, $t_1$).

It goes without saying that for N greater than 3, the apparatus can be extended accordingly for mixing N complex information signals, with N greater than three. Thus, for N=4, a device contains:

- a fourth input, in addition to inputs 602, 603 and 604 in FIG. 6, for receiving a fourth complex information signal $v_4(f, t_1)$,
- an additional line for supplying the fourth complex information signal $v_4(f, t_1)$ to an additional input of unit 640,
- an additional unit, in addition to units 608, 617 and 620 in FIG. 6,
- an additional control line for controlling the additional unit by control unit 630 in FIG. 6,
- additional line(s) from unit 640 for supplying the radius value (the radius values) to the additional unit,
- two additional output lines from the additional unit to one additional input of units 648 and 650 in FIG. 6, and
- a fourth input, in addition to inputs 660, 662 and 663 in FIG. 6, for receiving a fourth coefficient c4.

Analogously, as described above for N=2 and N=3, a computational representation of a position L which is three-dimensionally linearly interpolated or extrapolated from four given positions L1, L2, L3 and L4 is $$L=L1*c1+L2*c2+L3*c3+L4*c4,$$

where c1, c2, c3 and c4 are coefficients, with $$c1+c2+c3+c4=1.$$

If L1, L2, L3 and L4 are replaced by the microphone positions of the microphones providing the corresponding microphone signals $s_1(t)$, $s_2(t)$, $s_3(t)$ and $s_4(t)$, then c1, c2, c3 and c4 are the coefficients of the interpolation or extrapolation according to the invention. In summary, the following can be said.

Splitting the frequency-matching frequency values in first and second components, and combining the first and second components, respectively, is based on the assumption that the sound field consists of the superposition of two direct sound fields, wherein each of the components corresponds to one of the assumed direct sound fields. By this assumption, a mixture (interpolation or extrapolation) can be used for the components, which simulates the physical relationship of the sound field variable of a direct sound field and the position in space. Using this assumption results in the mixed (interpolated or extrapolated) signal being a good estimate of the value of the sound field measure at the interpolated or extrapolated position, as long as the sound field is caused by the sound waves of up to two sound sources.

Due to the equality of the amplitudes of all the first components and the equality of the amplitudes of all second components, the simulation of the physical relationship can be very simplistic, namely limited to a direct sound field with a planar wave front.

The equality of the mean energy of the interpolated or extrapolated components and the mean energy of all microphone signals means that a side assumption is used under which the mean energy of the sound field value in space is constant. As a result of this side assumption, the interpolated or extrapolated signal is still a useful estimate of the sound field value at the interpolated or extrapolated position as long as the assumption of at most two direct sound components deviates from reality.

The equality of the energies of all first components causes that the energies of the first components do not have to be interpolated or extrapolated, but the energy of the first interpolated or extrapolated component can simply be equated to them. The latter is so done. As a result, the first interpolation or extrapolation boils down to an interpolation or extrapolation of the phases of the first components.

The same applies analogously for the second components, the second interpolated or extrapolated component, the second interpolation or extrapolation and the phases of the second components.

The invention claimed is:

1. A method of mixing N information time signals which are respectively converted from the time domain to the frequency domain into one of N complex information signals, where N is an integer greater than 1, the method comprising the steps of:

(a) spectral values of the N complex information signals which match in a frequency are each converted into a corresponding first and a second component, wherein each of the first and second components for each of the respective spectral values are selected such that they would yield the respective spectral value if a complex value addition of the first and second component were performed, (b) the N first components of the N frequency-matching spectral values are combined into a first combination component, (c) the N second components of the N frequency-matching spectral values are combined into a second combination component, (d) the first combination component and the second combination component are combined into a result spectral value, (e) the steps (a) to (d) are also performed for other frequency-matching spectral values of the N complex information signals for generating other result spectral values, (f) wherein the obtained result spectral VALUES form a complex output information signal.

2. The method according to claim 1, wherein, for the derivation of a first combination component in step (b), the first components derived in step (a) have amplitudes which are substantially equal.

3. The method according to claim 1, wherein, for the derivation of a second combination component in step (c), the second components derived in step (a) have amplitudes which are substantially equal.

4. The method according to claim 1, wherein, for the derivation of the first and second combination components in step (b) and step (c), the first and second components derived in step (a) have amplitudes which are substantially equal.

5. The method according to claim 1, wherein the combining of the first and second combination components for obtaining the result spectral value in step (d) is realized such that a complex-valued addition of the first combination component and the second combination component results in the result spectral value.

6. The method according to claim 1, wherein the N first components are represented in a complex plane as vectors starting from an origin of the complex plane, and the end points of the vectors lie on a circle in the complex plane, wherein the mixing of the N information signals takes place at a ratio of c1 to c2 to c3 to . . . cN, where c1+c2+c3++cN=1, and the combining of the N first components for obtaining the first combination component in step (b) is realized such that the first combination component is represented as a vector from the origin in the complex plane and the end point of the first combination component is on the circle, where the angle between the first combination component and an axis of the complex plane is related to the angles between the N first components and the axis as follows:

$\alpha_c$=c1 * $\alpha_1$+c2 * $\alpha_c$+c3 * $\alpha_3$++cN * $\alpha_N$, where $\alpha_c$ is the angle between the first combination component and the axis and $\alpha_1$ through $\alpha_N$ are the angles between the N first components and the axis.

7. The method according to claim 1, wherein the N second components are represented in a complex plane as vectors starting from an origin of the complex plane, and the end points of the vectors lie on a circle around the origin of the complex plane, wherein the mixing of the N information signals takes place at a ratio of c1 to c2 to c3 to . . . cN, where c1+c2+c3++cN=1, and the combining of the N second components for obtaining the second combination component in step (c) is realized such that the second combination component is represented as a vector from the origin in the complex plane and the end point of the first combination component is on the circle, where the angle between the second combination component and an axis of the complex plane is related to the angles between the N second components and the axis as follows:

$\alpha_c$=c1 * $\alpha_1$+c2 * $\alpha_2$+c3 * $\alpha_3$++cN * $\alpha_N$, where $\alpha_c$ is the angle between the second combination component and the axis and $\alpha_1$ through $\alpha_N$ are the angles between the N second components and the axis.

8. The method according to claim 1, wherein N=2, the two first components are represented in a complex plane as vectors starting from an origin of the complex plane, and the end points of the vectors lie on a circle around the origin of the complex plane, wherein the mixing of the two information signals takes place at a ratio c1/c2, wherein c1+c2=1, and combining the two first components to obtain the first combination component in step (b) is realized such that the first combination component is represented as a vector from the origin of the complex plane, and the end point of the first combination component is on the circle, wherein the arc length of the circle portion from the end point of one of the first components to the end point of the first combination component and the arc length of the circle portion from the end point of the other first component to the end point of the first combination component behave like c1/c2.

9. The method according to claim 1, wherein N=2, the two second components are represented in a complex plane as vectors starting from an origin of the complex plane, and the end points of the vectors lie on a circle around the origin of the complex plane, wherein the mixing of the two information signals takes place at a ratio c1/c2, wherein c1+c2=1, and combining the two second components to obtain the second combination component in step (c) is realized such that the second combination component is represented as a vector from the origin of the complex plane, and the end point of the second combination component is on the circle, wherein the arc length of the circle portion from the end point of one of the second components to the end point of the second combination component and the arc length of the circle portion from the end point of the other second component to the end point of the second combination component relate to another like c1/c2.

10. The method according to claim 4, wherein the first and second components are represented in a complex plane as vectors starting from an origin of the complex plane and the end points of the vectors lie on a circle around the origin of the complex plane, wherein the radius of the circle is:

$$\text{radius} = \sqrt{\frac{1}{N}\sum_{i=1}^{N}(|v_i(f_1, t_1)|^2)}$$

where $|v_1(f_1, t_1)|$ are absolute values of the N frequency-matching spectral values of the N complex information signals.

11. The method according to claim 2, wherein the first components are represented in a complex plane as first vectors starting from an origin of the complex plane and the end points of the first vectors are located on a first circle around the origin of the complex plane and the second components are represented in the complex plane as second vectors starting from the origin and the end points of these second vectors are located on a second circle around the origin of the complex plane, wherein the radii of the first circle and the second circle are derived as follows:

$$\text{radius of the first circle} = \sqrt{\frac{1}{N}\sum_{i=1}^{N}(|v_i(f_1, t_1)|^2) + Ed}$$

$$\text{radius of the second circle} = \sqrt{\frac{1}{N}\sum_{i=1}^{N}(|v_i(f_1, t_1)|^2) - Ed}$$

where $|v_1(f_1, t_1)|$ are the absolute values of the N frequency-matching spectral values of the N complex information signals, and Ed is a value greater than zero, at most a value at which the vectors of the two components, which are formed from one of the N frequency-matching spectral values, are collinear.

12. A mixing apparatus for carrying out the method according to claim 1, provided with inputs for receiving the N complex information signals and a mixing unit for mixing the N complex information signals into a complex output information signal, wherein the mixing unit comprises:

a. a first unit for converting each of the frequency-matching spectral values of the N complex information signals into a first and a second component, b. a second unit for combining the N first components of the N frequency-matching spectral values into a first combination component, c. a third unit for combining the N second components of the N frequency-matching spectral values into a second combination component, d. a fourth unit for combining the first and second combination components into a result spectral value, e. a control unit for controlling the first through fourth units to repeatedly derive result spectral values for other frequency-matching spectral values of the N complex information signals or for parallelly controlling a plurality of first, second, third and fourth units to derive result spectral values from the frequency-matching spectral values, f. an output for supplying the thus-derived result spectral values as the complex output information signal.

* * * * *